United States Patent [19]

Barriquand

[11] 4,207,759

[45] Jun. 17, 1980

[54] MACHINE, ESPECIALLY A DYEING MACHINE, FOR PIECES OF FABRIC

[75] Inventor: Bernard Barriquand, Roanne, France

[73] Assignee: Barriquand, Roanne, France

[21] Appl. No.: 917,408

[22] Filed: Jun. 21, 1978

[30] Foreign Application Priority Data

Jun. 22, 1977 [FR] France ..... 77 19068
Jun. 28, 1977 [FR] France ..... 77 19747

[51] Int. Cl.[2] ..... D06B 3/20

[52] U.S. Cl. ..... 68/15; 28/281; 68/22 R; 68/27; 68/152; 68/177; 68/181 R; 68/184

[58] Field of Search ..... 68/15, 22 R, 27, 148, 68/152, 158, 171, 177, 178, 181 R, 184; 28/257, 281

[56] References Cited

U.S. PATENT DOCUMENTS

| | | | |
|---|---|---|---|
| 2,555,065 | 5/1951 | Thomson et al. | 68/148 X |
| 3,911,702 | 10/1975 | Eckrodt | 68/177 |
| 4,006,612 | 2/1977 | Thies | 68/152 X |
| 4,015,452 | 4/1977 | Kreitz | 68/177 X |
| 4,020,658 | 5/1977 | Thies, Jr. | 68/177 X |
| 4,083,208 | 4/1978 | Ekstroem | 68/178 X |
| 4,129,017 | 12/1978 | Greer | 68/177 X |

FOREIGN PATENT DOCUMENTS

| | | | |
|---|---|---|---|
| 2232770 | 1/1974 | Fed. Rep. of Germany | 68/152 |
| 2448385 | 4/1976 | Fed. Rep. of Germany | 68/158 |
| 1411323 | 8/1965 | France | 68/177 |

*Primary Examiner*—Philip R. Coe
*Attorney, Agent, or Firm*—Browdy and Neimark

[57] ABSTRACT

A machine for dyeing, bleaching and drying pieces of fabric includes a generally circular, rotatable vat, an overflow box to which treating liquid is pumped from the bottom of the apparatus, the overflow box being positioned above the rotating vat, optionally a guiding and impregnation tube for carrying the fabric and treating liquid between the overflow box and the rotating vat, a roller for carrying the fabric to be treated and for recirculating such fabric between the vat and the overflow box, and a safety device for stopping movement of travel of the fabric when knotting or bunching occurs between the roller and the overflow box.

15 Claims, 11 Drawing Figures

Fig. 5
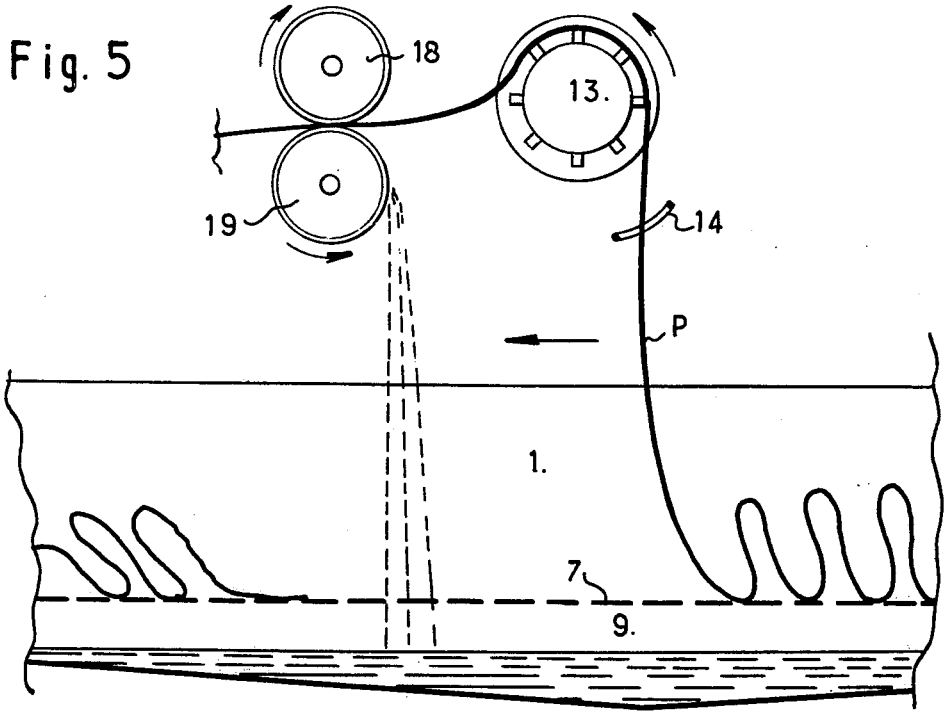
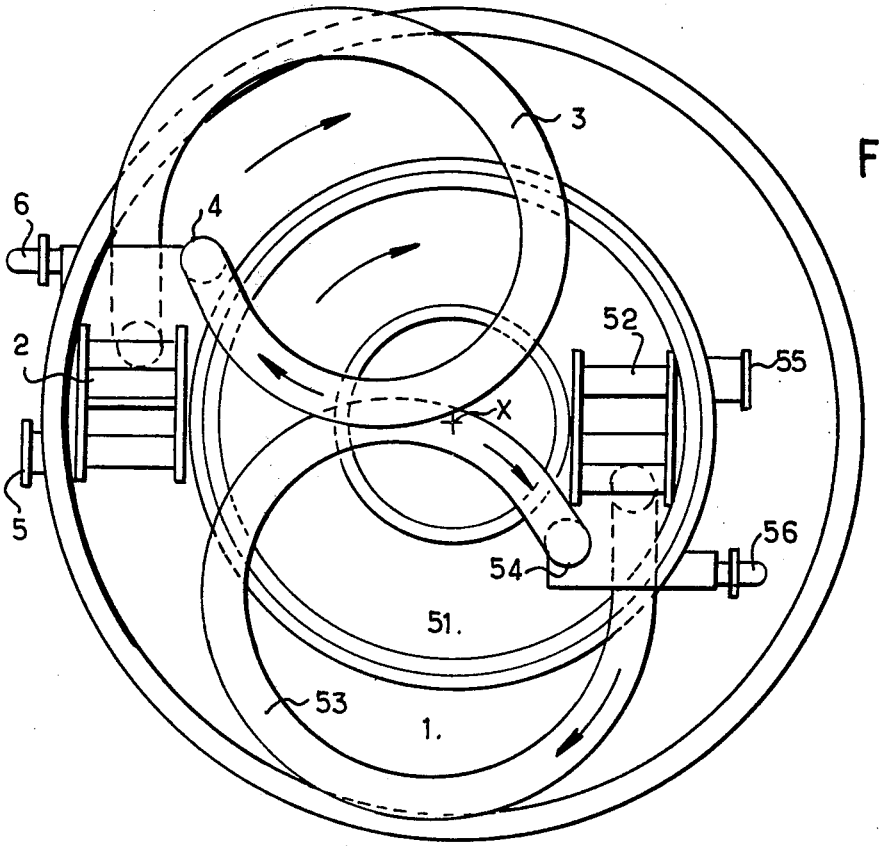
Fig. 6

MACHINE, ESPECIALLY A DYEING MACHINE, FOR PIECES OF FABRIC

FIELD OF THE INVENTION

The invention relates to machines for dyeing, bleaching and drying fabrics.

BACKGROUND OF THE INVENTION

According to the current state of the art regarding dyeing, bleaching, and drying, different machines are used, some of which comprises a nozzle which serves to spray the bath over the fabric, thus causing the latter to circulate in a tube. Another system consists in propelling the fabric by an overflow from the bath, produced by a device mounted at the inlet of the tube in which the fabric is caused to circulate. Processes which have been known since time immemorial include those in which the bath circulates around the pieces of fabric which are held in a fixed position, and those in which the fabric is driven inside baths contained in fixed vats.

The disadvantages of these various processes are well known. First, they require relatively large amounts of bath, on the order of 10 liters per kg of fabric. Second, these machines are very bulky. Finally, they do not comprise any device for drying.

SUMMARY OF THE INVENTION

The present invention relates to a machine for dyeing and bleaching pieces of fabric, optimally meeting the requirements of modern practice, especially by requiring only a small amount of bath and having a small bulk and consequently having a lower cost. Finally, this machine is equally suitable for drying pieces of fabric.

The machine according to the invention, comprises a device referred to as type one, comprising an essentially round vat, with a vertical axis, to contain the fabric to be treated; a device called type two, which comprises means of driving the fabric hydraulically, the total of these means being called the overflow box, and comprising in turn a detection and safety means arranged to pivot around a horizontal axis while occupying one of two corresponding positions, the first position for normal operation of the machine and the second position corresponding to when the machine is initially stopped or then reversed; disposed beneath said vat and a pump for recycling the liquid bath; a roller with a horizontal axis, called the feed roller, receiving the piece of fabric to be processed when it emerges from the vat; a tube or the like for guiding and impregnating said piece of fabric which it introduces into the vat, in one embodiment said tube being located completely above said vat.

The means of hydraulic propulsion, called the overflow box of the bath, according to one embodiment of the invention, can comprise a tube with a biconical shape. According to another embodiment of the invention, this tube can have a conical shape. According to yet another embodiment, this tube is perforated. According to yet another embodiment, the overflow box of the bath comprises a lateral nozzle.

The machine according to the invention can comprise a feed roller with a horizontal axis, mounted upstream of the bath overflow box. According to one embodiment of the invention, this roller rotates loosely on its axis; according to another embodiment, this roller is caused to rotate by appropriate means.

According to one advantageous embodiment of the invention, the rotating device is the type one device.

As far as the vat is concerned, it may contain a perforated bottom (if required) and possibly one perforated wall.

A heat exchanger can be interposed in the liquid circulation line between the recycling pump and the bath overflow box.

According to one embodiment of the invention, two drying rollers are arranged to cooperate with the feed roller.

According to other embodiments of the invention, the machine comprises a plurality of type two devices, the vat then being enlarged so as to receive the fabric as it emerges from all of these devices.

On the other hand, the vat of the machine can comprise a plurality of concentric compartments, with a type two device being mounted above each of these compartments; the feed roller, the pump, and the exchanger can then be common.

According to another embodiment of the invention, a first assembly, consisting of a type one device and a type two device, is placed above another device constituted in the same fashion, with the machine tank being common.

The fabric treated by an assembly constituted by a type one device and a type two device, after extraction, is introduced into another assembly constituted in the same fashion.

In another embodiment of the invention, the rotating device is the type two device, with a rotating joint then being mounted on the axis of the machine, in the upper part of the bath recycling line.

The machine according to the invention can also operate in an autoclave.

Other characteristics of the invention will be apparent from the description which follows and from the attached drawings, said description and drawings being provided for purely informational purposes and providing no limitations whatever.

BRIEF DESCRIPTION OF THE DRAWINGS

FIG. 5, similar to FIG. 4, shows a version in which two drying and squeezing rollers are added, cooperating with the feed roller;

FIG. 6 is a top view of another embodiment of the invention, comprising a duplication of the assembly constituted by a type one device and a type two device, as well as heat exchangers and bath circulation lines;

DETAILED DESCRIPTION OF THE PREFERRED EMBODIMENT

Figure 1:
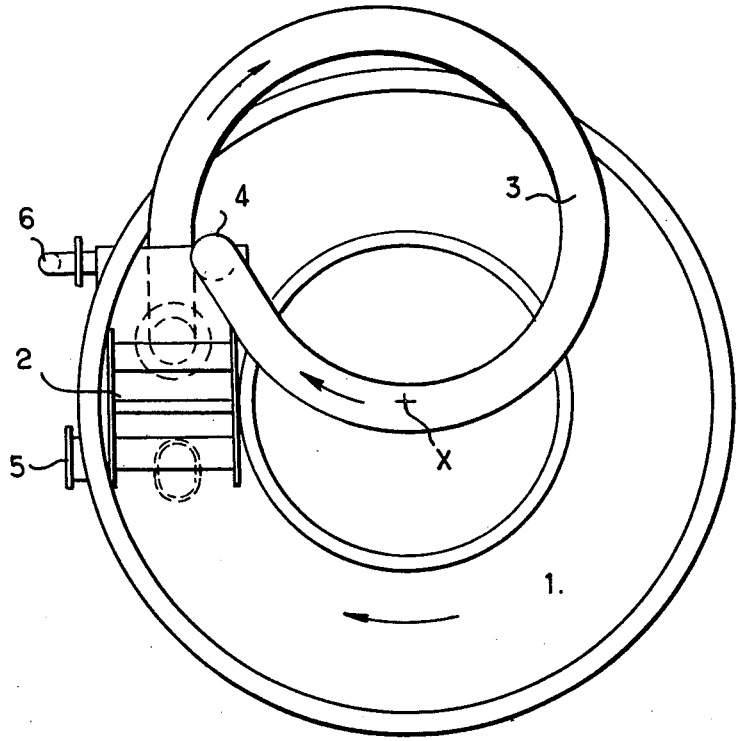
FIG. 1 is a top view of an embodiment of the invention.
Figure 7:
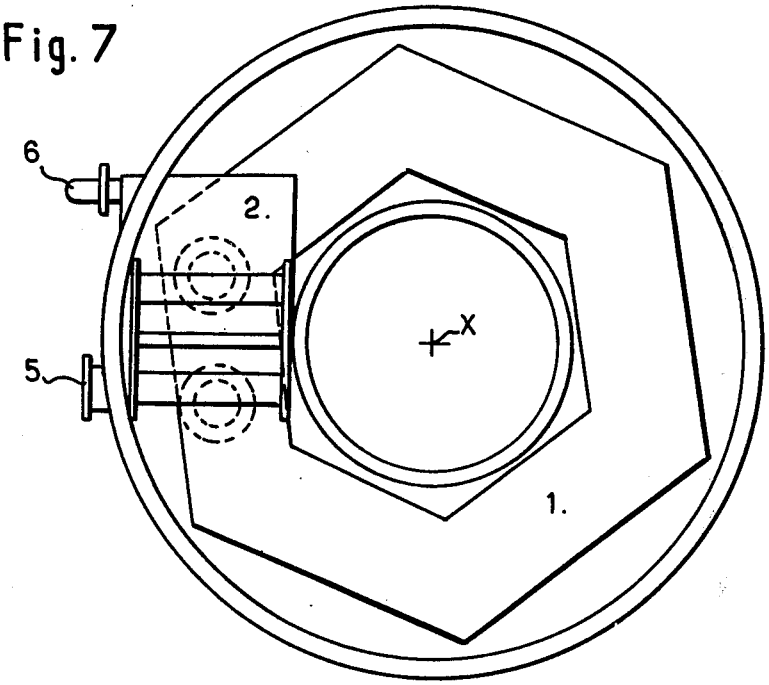
FIG. 7 is a top view of a machine having a hexagonal vat.

FIG. 1 shows at 1 the vat of the machine, having an essentially round shape, capable of rotating around vertical axis X. Other shapes, such as the hexagonal shape of FIG. 7, may be provided for the vat 1. Reference numeral 2 represents the heat exchanger, followed by a guide and impregnation tube 3. This tube is recurved upon itself and terminates at 4 in vat 1. It is generally mounted above this vat.

Figure 8:
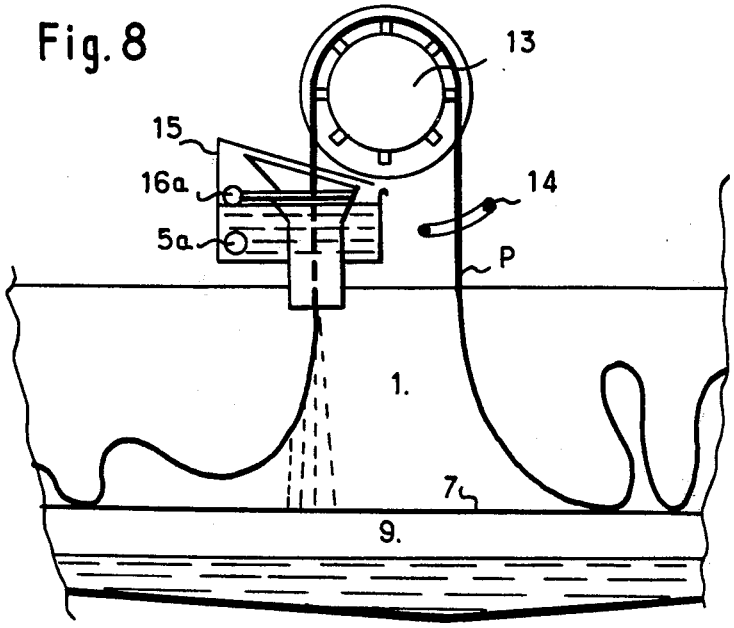
FIG. 8 is a partially enlarged vertical cross section of a simplified embodiment of the machine.

FIG. 8 shows a simplified machine which does not contain a guide and impregnation tube, with the fabric emerging from a bath overflow box 15 going directly to the bottom 7 of vat 1.

Figure 3:
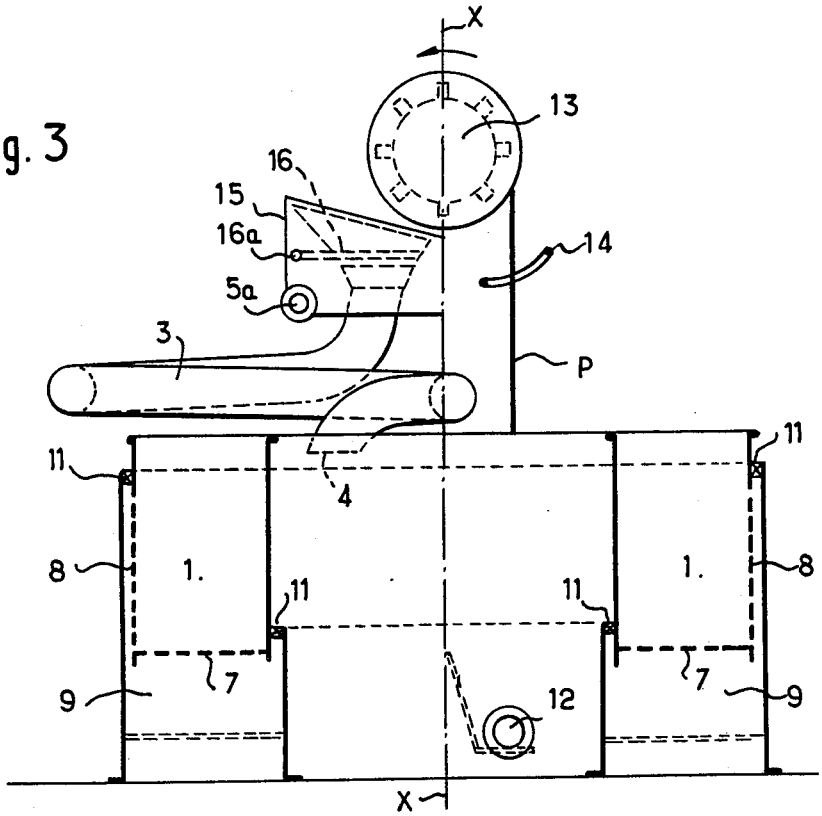
FIG. 3 is a vertical schematic cross section through FIG. 1.

A recycling and circulating pump, not shown, draws in the liquid through strainer 5, returning it at 5*a* to the bath overflow box 15 after passing through heat exchanger 2 as shown in FIGS. 1, 3, and 8.

Figure 2:
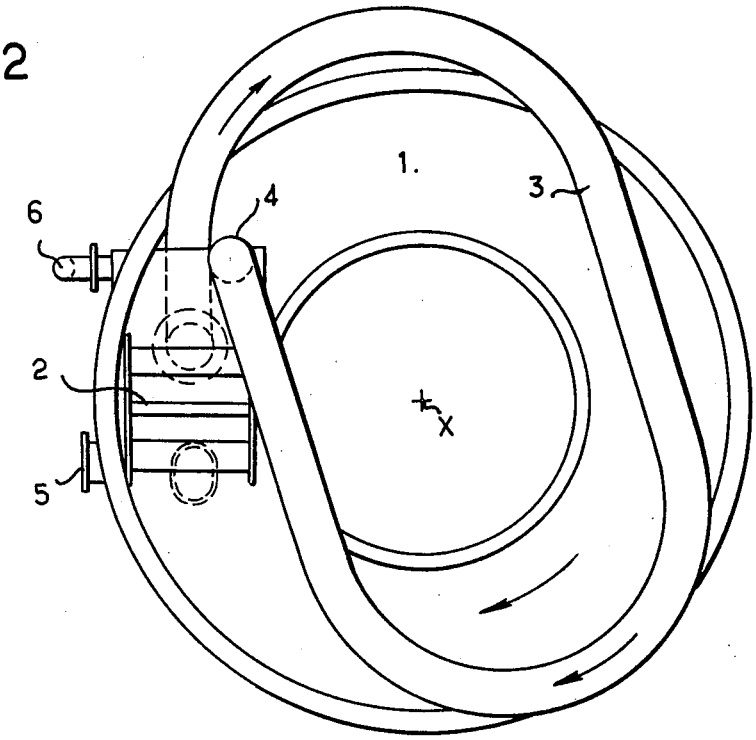
FIG. 2 is a top view of another embodiment of the invention, having the peculiarity of having a longer guide and impregnation tube.

FIG. 2 shows a variation of the invention in which the guide and impregnation tube 3 is longer than that in FIG. 1, also having an elongated shape which is advantageous in certain cases.

The perforations in lateral wall 8 as shown in FIG. 3 are especially indispensable when the machine is operated as a dryer, as indicated below.

When vat 1 rotates, above recovery tank 9, it is guided by an appropriate device 11. Reference numeral 12 shows the means which cause said vat 1 to rotate as shown in FIG. 3.

Figure 4:
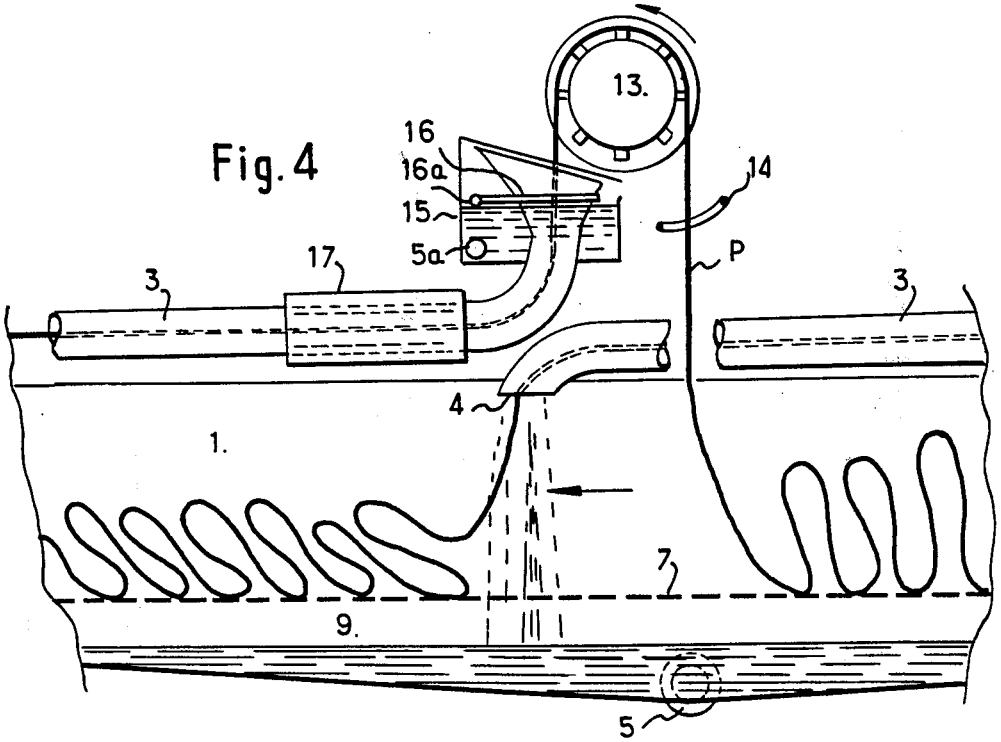
FIG. 4 is an enlarged detail of FIG. 3.

At the lowest point in tank 9 is the return strainer 5, shown in FIG. 4, where the recycling line begins, comprising primarily the pump, and returning the dyeing bath at 5*a* to overflow box 15.

Feed roller 13 for raising and conveying piece of fabric P is shown in FIGS. 3–5, 8 and 11, with the roller being optionally mountable loosely on its axis or, on the contrary, set rotating by appropriate means, especially a variable speed motor. A guiding ring 14, used to guide the piece of fabric P, is located upstream of roller 13.

Bath overflow device 15 is equipped with a safety system 16, causing the upper part of the device to pivot around its axis 16*a* each time fabric P has a tendency to bunch-up or form knots downstream of roller 13, the accumulated portions of the fabric pushing against the walls of the pivoting part of the safety device 16, thus causing it to pivot downward, triggering a device which reverses the motor driving the roller 13, causing the roller and vat to stop and then reverse the direction of its movement until the fabric is untangled by being pulled in the reverse direction; the pivoting part of the overflow box 15 is then relieved of the excess weight previously caused by the tangled portion or knot and consequently returns to its initial position, similarly returning the reversing switch to its initial position; roller 13 then instantaneously resumes its forward movement.

When it leaves the overflow box 15, the fabric enters a perforated tube 17, followed by the guide and impregnation tube 3 already mentioned as shown in FIG. 4.

According to one version of the invention, the machine can be provided with a plurality of devices as shown in FIGS. 6 or 9–11.

Figure 9:
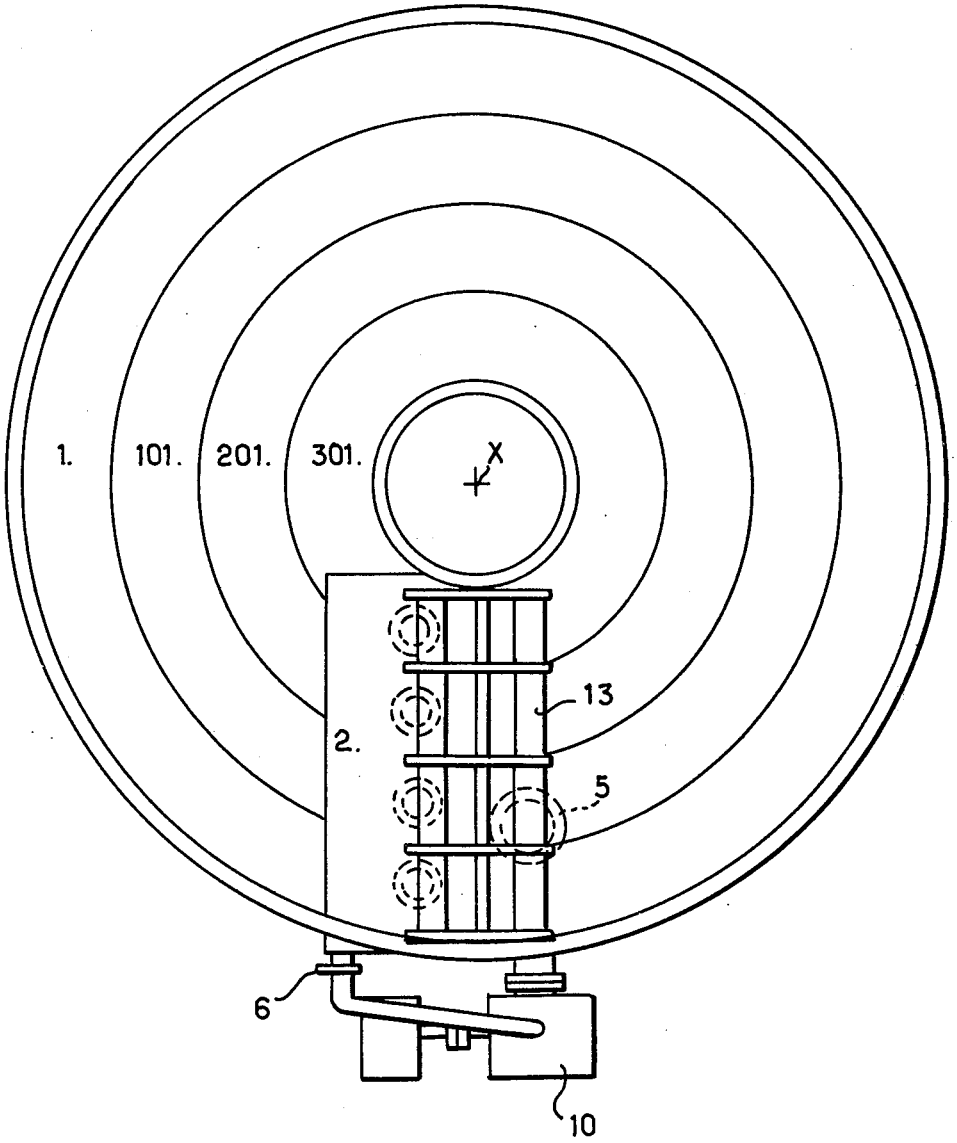
FIG. 9 is a top view of a machine with four coaxial vats, fitted with one feed roller and one pump.
Figure 10:
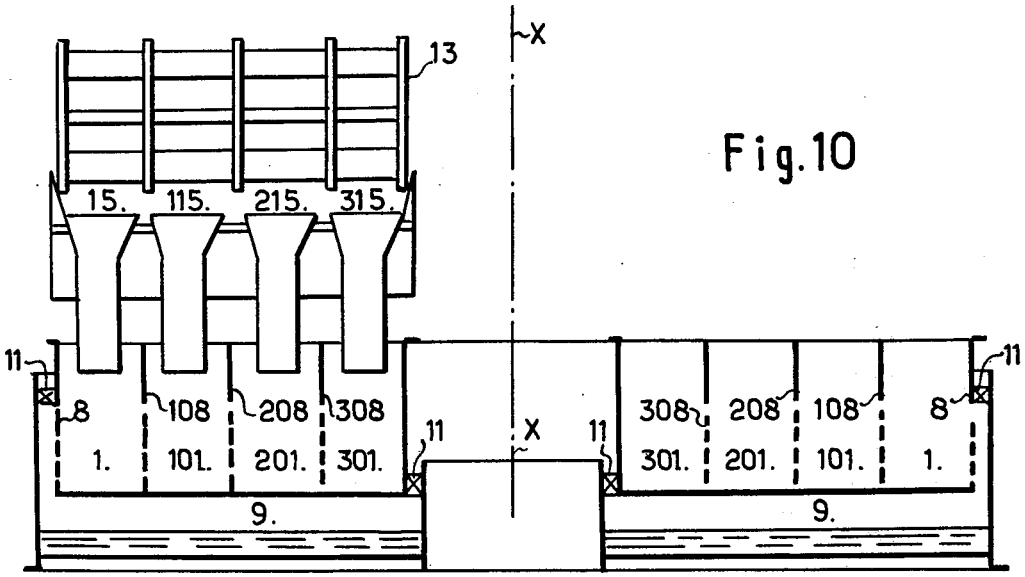
FIG. 10 shows in a partial cross section a variation of the machine according to FIG. 9, with a solid bottom, with perforated lateral walls, and with a single recovery tank.
Figure 11:
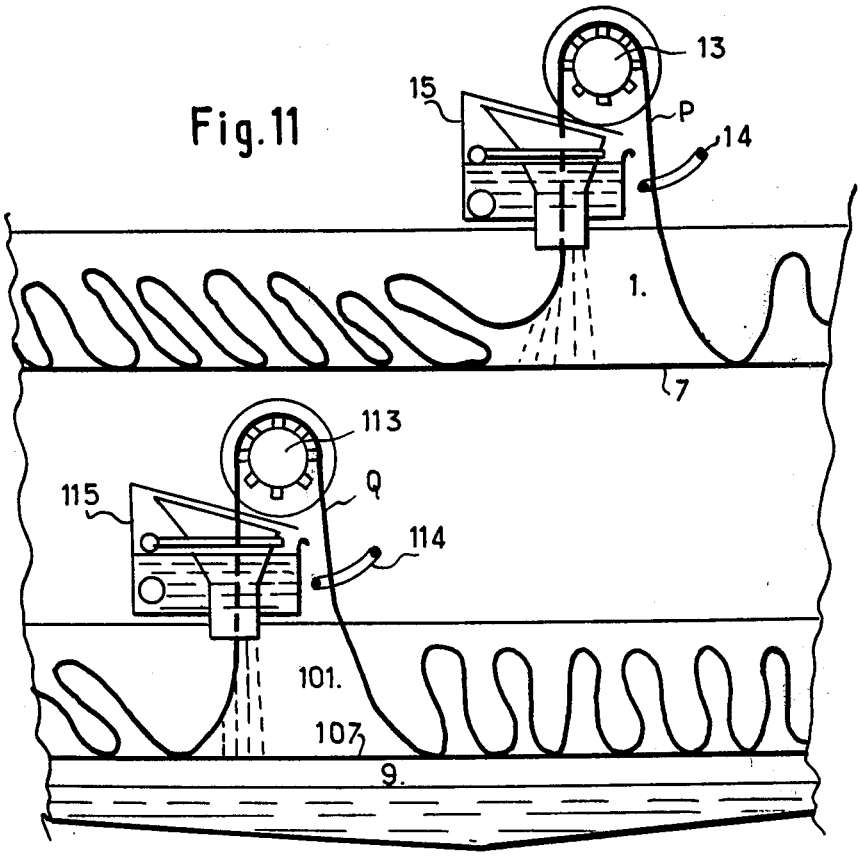
FIG. 11 is a partially enlarged vertical cross section showing a machine with two superimposed stages.

Various combinations are therefore possible, optionally comprising a single feed roller or on the contrary an individual roller for each device. For example, FIG. 11 shows a second roller 113, and FIGS. 9 and 10 show rollers 13 adjacently arranged.

Such combinations offers the advantage of considerably reducing the bulk and therefore the cost of the machine.

According to another embodiment of the invention, the apparatus can comprise a machine, arranged in a plurality of superimposed stages, each stage comprising an assembly of type one and type two devices; the advantages are the same as those outlined above. FIGS. 9 and 10 show paths arranged in parallel, i.e. coaxial, to one another.

A single tank can suffice for a complex machine, as can a single feed pump.

When one of the feed rollers 13 is used as a relay roller for the fabric, this roller is mounted loosely on its shaft. This latter embodiment is particularly suitable for cases in which the means of hydraulic propulsion has a biconical or conical shape, or the shape of a perforated tube.

According to a particular embodiment of the invention, the fabric, as it emerges from an assembly comprising type one and type two means, is introduced into another assembly constituted in the same fashion.

In some of the drawings, the various elements, when they have been multiplied, have been represented by references increased respectively by 100, 200 or 300, when the corresponding elements have been doubled, tripled, or quadrupled as shown in FIGS. 9–11.

In certain specific cases, the bath overflow box 15 can be reduced to a simple perforated tube or to an equivalent device.

As pointed out above, machines according to the invention in their various versions can serve equally well for dyeing or bleaching of pieces of fabric, as well as for drying the latter.

The function of the machine is explained as follows: tank 9 is filled with a bath (a dye bath or bleaching bath). The recycling pump is turned on and heat exchanger 2 is set appropriately. The end of the piece P of fabric is placed on feed roller 13, which is set rotating, as is vat 1. Propelled hydraulically by overflow device 15, the piece enters perforated tube 17 as shown in FIG. 4, then guide and impregnation tube 3, after which it falls into vat 1, where it is propelled mechanically primarily by the rotation of this vat when it rotates. After making one complete cycle, the end of piece P returns to roller 13, where it is picked up again to be combined with its other end, thus forming an endless loop. The desired number of cycles through the vat can then be performed with this loop, after which the two ends are disconnected and the piece removed from the machine.

In order to make the machine operate as a dryer, the piece of fabric is detached from roller 13 after separating its ends. The piece is then separated from tubes 17 and 3, the fabric then being located completely inside vat 1 from which the bath is then drained, after which the vat is caused to rotate at high speed to ensure initial drying. Then, as shown in FIG. 5, the fabric is passed first over roller 13, then between drying rollers 18 and 19, producing final drying.

One of the most remarkable advantages of this machine according to the invention is that it requires only a very limited quantity of bath, a quantity which at its limit is such that it suffices to enable the recycling pump to operate without running dry. This feature is important because of the water shortage which is becoming felt on a global scale.

In addition, the machine according to the invention also allows considerable savings of coloring products, bleaching products, and various additives.

However, it goes without saying that if necessary the machine according to the present invention can function equally well when used for dyeing with a full tank.

As far as the bulkiness of the machine is concerned, it is very much less than that of machines known thus far.

It goes without saying that the invention is not limited merely to the embodiments described hereinabove; all versions which can be derived from them are included in the invention without reducing its scope thereby.

I claim:

1. A processing machine, especially for dyeing, bleaching, and drying pieces of fabric, comprising:

vat means of generally annular shape for containing and conveying an elongated strip of fabric along a generally circular path in a gaseous atmosphere, said vat means being rotatable about a vertical axis and having a perforated bottom wall; and means for rotating said vat means about said vertical axis;

a liquid recovery tank located beneath said vat means for receiving liquid passing through the perforated bottom of said vat means;

hydraulic propulsion and treating means to receive the elongated fabric, to treat the fabric with a liquid dyeing or bleaching bath and to hydraulically pass the fabric with the liquid therethrough to the vat, said means comprising an overflow box mounted above said vat means;

feed roller means, mounted horizontally above said vat and adjacent said overflow box, for passing the fabric into said overflow box, and adapted to engage the fabric when the fabric emerges from the vat;

recycling pump means, for pumping the liquid from said recovery tank to said overflow box; and detection and safety means, for determining the formation of tangles and knots in said fabric as it passes through said overflow box, and including a pivoting means for pivoting around a horizontal axis when tangles or knots in the fabric contact said pivoting means, said pivoting means being normally in a first position whereby said roller means is driven forwardly to feed fabric to said overflow box, and said pivoting means having a second position whereby the fabric intially ceases its forward movement and is then propelled backwardly.

2. A processing machine, according to claim 1, wherein said overflow box further comprises a heat exchanger, in communication with the liquid in said overflow box.

3. A processing machine, according to claim 1, wherein said vat means includes a perforated lateral wall.

4. A processing machine, according to claim 1, further including a second identical overflow box, mounted above said first overflow box, said recovery tank being disposed beneath said first and second overflow boxes.

5. A processing machine, according to claim 4, further comprising means to introduce the fabric, extracted from said first overflow box, into said second overflow box.

6. A processing machine, according to claim 1, further including a second overflow box, identical to said first overflow box, and means for introducing the fabric, extracted from said first overflow box, into said second overflow box.

7. A processing machine, according to claim 1, wherein said hydraulic propulsion means for hydraulically propelling the fabric using the liquid dyeing or bleaching bath further comprises a guiding and impregnating tube located above the bottom of said vat and the entrance of which is located to receive the liquid bath and the fabric leaving the overflow box.

8. A processing machine, according to claim 7, wherein said overflow box comprises a biconical tube at the inlet thereof.

9. A processing machine, according to claim 7, further comprising a perforated tube between said overflow box and said guiding and impregnating tube.

10. A processing machine, according to claim 7, further including two drying rollers through which the fabric passes.

11. A processing machine, according to claim 7, wherein said overflow box includes a tube with a conical inlet.

12. A processing machine, according to claim 7 wherein said guiding and impregnating tube extends laterally.

13. A precessing machine, according to claim 7, further comprising at least two hydraulic propulsion means, and wherein said vat means is large enough to receive the fabric extracted from all of said hydraulic propulsion means.

14. A processing machine, according to claim 13, wherein said vat means is divided into a plurality of concentric compartments, with one hydraulic propulsion means being located above one of said compartments.

15. A processing machine, according to claim 1, further comprising a rotating means for rotating said feed roller.

* * * * *